United States Patent [19]

Hochgesang et al.

[11] 4,431,253

[45] Feb. 14, 1984

[54] COAXIAL PLUG CONNECTOR

[75] Inventors: Gerhard Hochgesang, Bad Neustadt; Berthold Stürmer, Bad Neustadt, both of Fed. Rep. of Germany

[73] Assignee: Preh Elektrofeinmechanische Werke Jakob Preh Nachf. GmbH & Co., Bad Neustadt, Fed. Rep. of Germany

[21] Appl. No.: 315,752

[22] Filed: Oct. 28, 1981

[30] Foreign Application Priority Data

Nov. 4, 1980 [DE] Fed. Rep. of Germany ..... 3041495

[51] Int. Cl.[3] ..... H01R 17/18

[52] U.S. Cl. ..... 339/177 R

[58] Field of Search ..... 339/17 C, 177 R, 177 E, 339/120, 121, 122 R, 17 R, 218, 217 R

[56] References Cited

U.S. PATENT DOCUMENTS

| | | | |
|---|---|---|---|
| 1,590,823 | 6/1926 | Hewitt | 339/139 C |
| 3,082,395 | 3/1963 | Madansky | 339/218 R |
| 3,564,478 | 2/1971 | Hampton | 339/17 C |

FOREIGN PATENT DOCUMENTS

| | | |
|---|---|---|
| 1757188 | 12/1957 | Fed. Rep. of Germany . |
| 1591574 | 11/1969 | Fed. Rep. of Germany . |
| 2547951 | 5/1977 | Fed. Rep. of Germany . |
| 485338 | 1/1970 | Fed. Rep. of Germany . |
| 2363316 | 8/1974 | Fed. Rep. of Germany . |
| 2510299 | 10/1975 | Fed. Rep. of Germany . |
| 2507328 | 11/1975 | Fed. Rep. of Germany . |
| 2729649 | 1/1979 | Fed. Rep. of Germany . |
| 2841676 | 3/1980 | Fed. Rep. of Germany . |
| 914326 | 1/1963 | United Kingdom . |

OTHER PUBLICATIONS

Periodical "Asian Sources Electronics Components," Sep. 1980, p. 346.

Krone, Coaxial Connector, pp. 1–11, 217.007/1.72 (3/1972).

*Primary Examiner*—Joseph H. McGlynn
*Assistant Examiner*—David L. Pirlot
*Attorney, Agent, or Firm*—Woodcock, Washburn, Kurtz, Mackiewicz & Norris

[57] ABSTRACT

A coaxial plug connector has a supporting body made of plastic material, there being retained therein at least one contact sleeve made of metal and provided with a terminal, the contact sleeve constituting an outer contact and embracing an insulating body having a central aperture in which an inner contact having a terminal is disposed. More specifically, the insulating body and supporting body are interconnected by at least one web so as to form an integral component, which component is manufactured by means of an injection molding operation in which the contact sleeve is simultaneously embedded in the component.

11 Claims, 5 Drawing Figures

COAXIAL PLUG CONNECTOR

BACKGROUND OF THE INVENTION

This invention relates to a coaxial plug connector comprising a supporting body made of a suitable plastic material in which there is fixedly secured, as an external contact, at least one contact sleeve made of metal and having a connecting element, said contact sleeve embracing an insulating body provided with a central aperture in which an inner contact comprising a connecting element is disposed.

BRIEF DESCRIPTION OF THE PRIOR ART

Coaxial plug connectors of this type are employed in entertainment industry apparatus, e.g. hi-fi systems, for the purpose of transmitting audio frequencies. In addition, they may be employed in educational systems in combination with single-plate calculators or with machinery control systems. Video engineering is still another field of application.

In DE-OS No. 25 47 951 there has been disclosed a plug socket in which an insulating body surrounded by a metallic shielding cap is held in position in a printed-circuit board by means of U-shaped supporting lugs. The insulating body, which is made of a suitable plastic material, is provided with a central aperture in which an inner contact in the form of a contact sleeve made of a plane piece of sheet metal is retained with a certain amount of freedom. For the purpose of axial positioning, this contact sleeve is provided with bent portions serving to support the sleeve on an end face of the insulating body. In addition, outwardly spread flexible tongues of the contact sleeve engage a rearwardly directed surface of a step forming a continuation of the central aperture. The contact sleeve is provided with a terminal lug permitting a soldered connection to be made. Since the plug socket is adapted to be mounted in an aperure of the printed-circuit board, the plug socket extends at right angles to the plane of the printed-circuit board.

A multiple arrangement of a coaxial plug connector termed "cinch plug connector" has already been disclosed in the periodical "Asian Sources Electronics Components," September 1980, p. 346; in this arrangement, the connection is effected by insertion in a direction extending parallel to the printed-circuit board. In a supporting body made of a plastic material a metallic contact sleeve forming an outer contact is secured. This contact sleeve is provided with a downwardly bent terminal lug. Mounted in this contact sleeve is an insulating body havng a central aperture containing the inner contact, the terminal lug of which is also bent downwardly.

OBJECT OF THE INVENTION

It is an object of this invention to provide a coaxial plug connector of the type mentioned above which as compared to conventional connectors comprises a smaller number of separately manufactured component parts and which is, therefore, adapted to be manufactured at lower cost.

SUMMARY OF THE INVENTION

According to the invention, this object is attained by the provision of a coaxial plug connector in which the insulating body and the supporting body are integrally interconnected by at least one web portion, in which the elements of the integral member are made by means of an injection process, and in which the contact sleeve is embedded in the plastic material.

The fact that the operations of injection-molding the insulating body and of embedding the contact sleeve in the supporting body makes it possible to save the time which would be required for making the insulating body in the form of a separate member. In addition, the cost of inserting and securing the contact sleeve to the supporting body and of mounting the insulating body in the contact sleeve is eliminated.

BRIEF DESCRIPTION OF THE DRAWINGS

The invention and further particulars will be described more specifically hereinafter with reference to two preferred embodiments shown in the drawings, in which.

DETAILED DESCRIPTION OF THE PREFERRED EMBODIMENTS OF THE INVENTION

Figure 1:
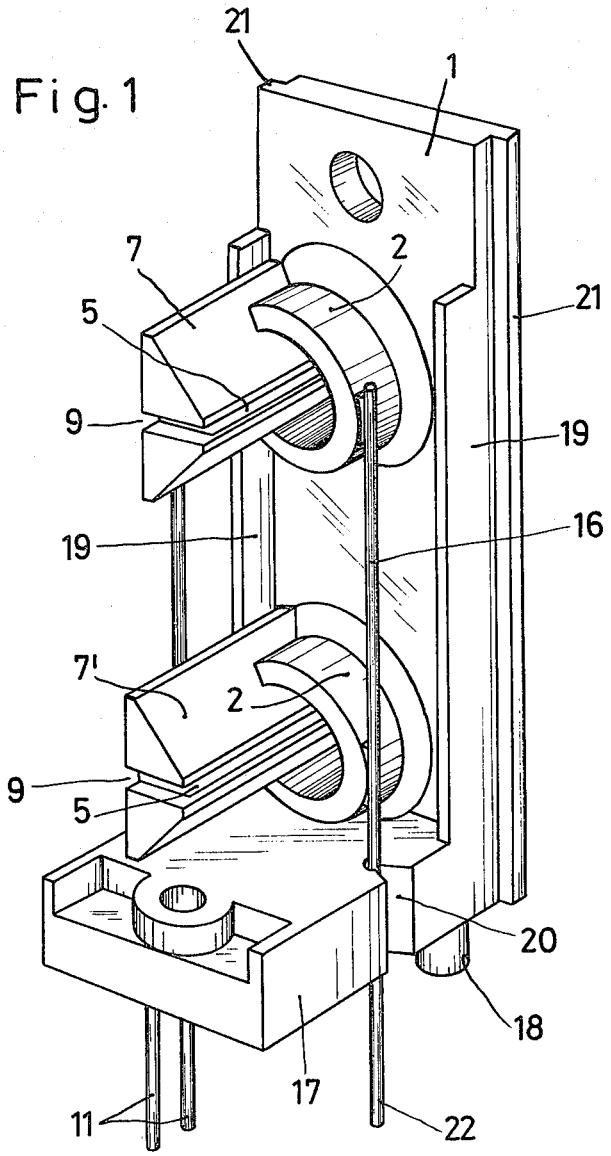
FIG. 1 is a perspective rear view of a coaxial plug connector according to the invention.
Figure 2:
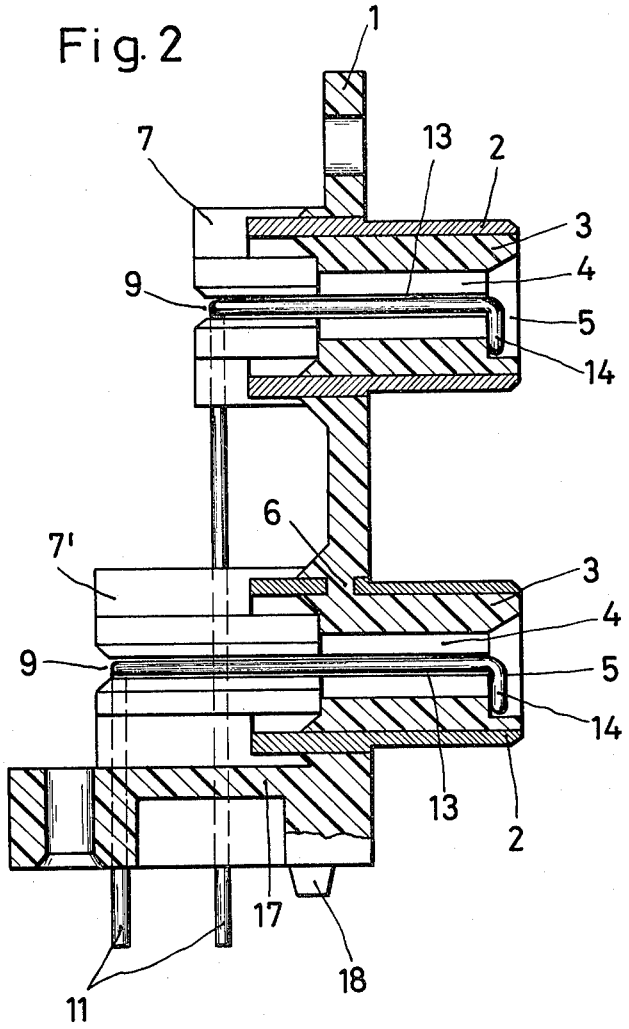
FIG. 2 is a longitudinal cross-section of the plug connector of FIG. 2.
Figure 4:
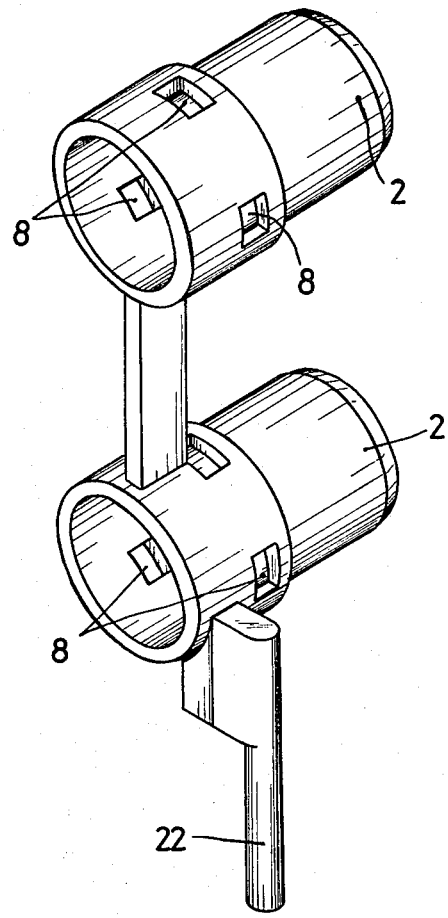
FIG. 4 is a perspective view of two contact sleeves forming an integral member.

Shown in FIG. 1 in a perspective view is a coaxial plug connector comprising a supporting body 1 made of a plastic material, there being embedded in the supporting body two contact sleeves 2 positioned one above the other and forming a multiple array. Each contact sleeve contains an insulating body 3 made of the same plastic material as the supporting body. The insulating body 3 and the supporting body 1 are interconnected by webs which may be of different shape. For example, as seen in FIG. 2, a first web 6 extends through an aperture 8 of the contact sleeve from supporting body 1 to insulating member 3. While there may be provided a single aperture only, it is possible, as shown in FIG. 4, to provide a plurality of apertures which are spaced along the periphery. The shape of the or each aperture is of no particular importance.

For the purpose of manufacturing the plug connector, the contact sleeves made of metal are first inserted into the injection mold and positioned therein. This is followed by forming the supporting body and the insulating body around the contact sleeves, the first webs being, of course, formed simultaneously to extend through the apertures 8 so as to provide a positive engagement between the elements named.

In FIG. 1, webs having a different shape are shown at 7 and 7'. In this case, the second web 7 extends from supporting body 1 over the edge of contact sleeve 2 towards insulating body 3. While both types of webs may be employed in a single connector, it is also possible to provide webs of the one or the other type only.

Figure 3:
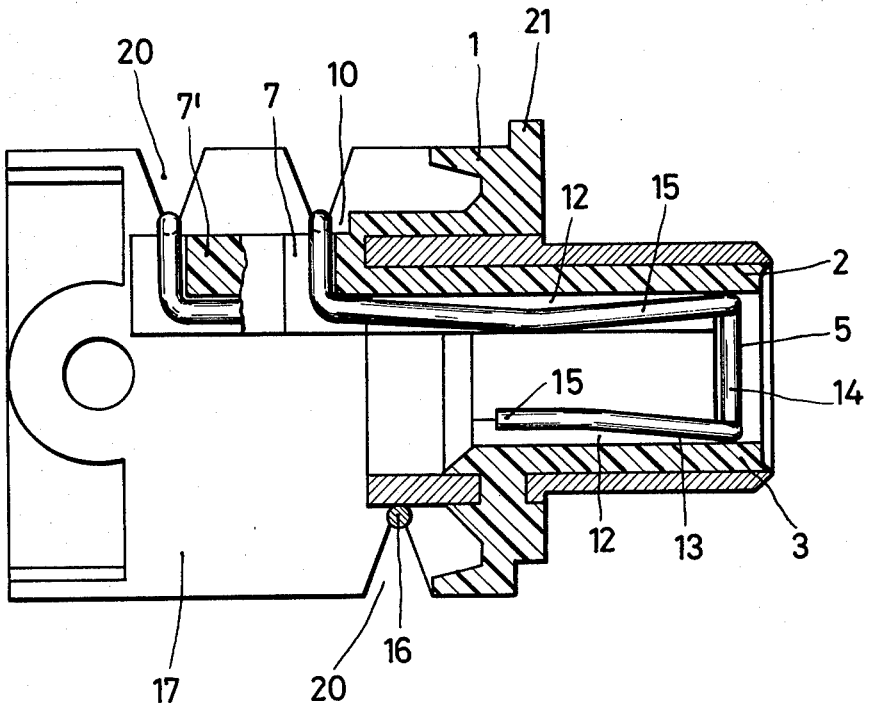
FIG. 3 is a transverse cross-section of the plug connector of FIGS. 1 and 2.
Figure 5:
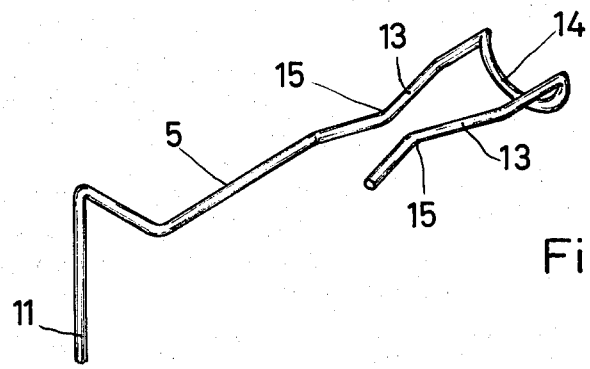
FIG. 5 is a perspective view of an inner contact.

Insulating body 3 is provided with a central aperture 4 which, as shown in FIG. 2, contains an inner contact 5 which, as shown in FIG. 5, constitutes, together with a terminal extension 11, an integral member made of wire. Connected to terminal extension 11 are, for example, two parallel portions 13 which are interconnected by an arcuate section 14 extending at right angles to sections 13. At approximately central positions, sections 13 are provided with angulated sections 15, each forming an obtuse angle. Since the inner contact 5 provided with sections 13 is disposed in recesses 12 (FIG. 3) provided in insulating body 3 serving to position the inner contact, the apices of sections 15 project into central aperture 4. The apices and the arcuate connecting portion 14 may thus be contacted by a plug (not shown) to be inserted into aperture 4.

The recesses 12 of insulating body 3 containing inner contact 5 are continued in the second webs 7 and 7', respectively, in the form of slots 9 provided on the inner surfaces of the webs as well as on their end faces. Through these slots, the inner contact 5, i.e. the parts extending from sections 13 thereof, extends to terminal 11. While this arrangement facilitates assembly operations, it affords the advantage that satisfactory and reliable insulation is ensured between contact sleeve 2 and inner contact 5. The rear surfaces of the webs are provided with recesses in which the terminals are located. As shown in FIG. 1, the plug connector described is adapted to be mounted in a printed-circuit board (not shown). For this purpose, supporting body 1 is of L-shape, the arrangement being such that the shorter portion forming a base plate 17 is brought into contact with the surface of the printed-circuit board. In order to ensure accurate positioning, the under side of base plate 17 is integrally formed with a downwardly projecting peg 18 adapted to extend into a suitable aperture of the printed-circuit board. If desired, it is additionally possible to secure the supporting body by means of screws. For the purpose of retaining the terminals 11 of inner contact 5 and the contact member 16 in base plate 17, the latter is provided with recesses 20 (FIG. 1) into which said elements are strung. The distance between these terminals, of course, corresponds to the modular dimension of 2.54 mm (one-tenth inch).

The coaxial plug connector of the invention may be constructed as a single connector as well as in the form of a multiple connector. The embodiment shown in FIG. 1 constitutes a twin arrangement comprising two contact sleeves spaced vertically one above the other. However, also the employment of more than two contact sleeves may be contemplated. In addition, it is possible to arrange a plurality of such supporting bodies side by side and thus to form a strip-shaped arrangement. For this purpose, the edges of the supporting bodies may be provided with tongues and grooves (not shown) permitting the various supporting bodies to be aligned. In the embodiment shown in FIG. 1, edge portions 21 forming steps are provided, these steps being brought into mutual engagement when several supporting bodies are disposed side by side. The supporting bodies may be interconnected, for example, by means of an adhesive. It is also possible to provide the supporting bodies with edge portions 19 on both longitudinal sides, said edge members of adjacent supporting members being brought into face contact and serving to act as energy directing means during ultrasonic welding operations.

In an embodiment comprising two contact sleeves, the two sleeves are arranged one above the other. In this case, the second web 7' is of greater length than the first web 7 which is upwardly spaced therefrom. This arrangement has been selected in order to provide, between the terminals of the inner contacts, a distance corresponding to said modular dimension. Also in this case, the terminal associated with second web 7' is disposed in a recess provided on its rear surface.

In the embodiment of FIG. 1, two contact sleeves 2 are electrically interconnected by means of contact member 16 welded thereto. Another embodiment is shown in FIG. 4. In contrast to the embodiment of FIG. 1, the contact sleeves 2 and the connections provided therebetween form an integral member. It is, of course, possible also to provide an integrally formed terminal 22; the remaining elements correspond to those shown in FIG. 1.

While the embodiments described above and shown in the figures, in which the supporting body is of L-shape, are adapted for mounting into a printed-circuit board, it is also possible to construct the supporting body in the form of a simple plate for different applications. In this case, the inner contact made of wire is conveniently provided with soldering eyelets permitting terminal wires to be connected.

What is claimed is:

1. A coaxial plug connector comprising a supporting body made of a plastic material in which there is retained, as an outer contact, a contact sleeve made of metal and provided with a terminal, said contact sleeve embracing an insulating body having a central aperture in which an inner contact having a terminal is disposed, characterized in that said insulating body and said supporting body are interconnected by at least one web so as to form an integral component, said contact sleeve being embedded in said component, and having a second web extending from said supporting body over an edge of said contact sleeve to merge into said insulating body, said second web having an inner surface and an end face and being provided with a slot on said inner surface and said end face which is adapted to receive said inner contact for the purpose of insulating it from said contact sleeve.

2. A coaxial plug connector as claimed in claim 1, characterized in that said supporting body has the shape of a plate and that the terminals of said contact sleeve and of said inner contact are formed as soldering eyelets.

3. The coaxial plug connector of claim 1, characterized in that said contact sleeve is frictionally and/or positively retained in position in said component.

4. A coaxial plug connector as claimed in claim 1 or claim 3, characterized in that a first web extends through an aperture of said contact sleeve.

5. A coaxial plug connector as claimed in claim 1, characterized in that a supporting body is provided with a plurality of plug connectors spaced one above the other, that with each connector the next lower second web has a greater length than the second web disposed thereabove, and that said second web disposed in a lower position is provided, on its outside, with a recess adapted to receive the terminal of said inner contact of the plug connector disposed thereabove.

6. The coaxial plug connector of claim 5, characterized in that, in a multiple arrangement, said contact sleeves are electrically interconnected by means of a contact member which is adapted simultaneously to serve the function of a terminal.

7. A coaxial plug connector as claimed in any of the preceding claims 1, 3 or 5, characterized in that said inner contact is made of an integral piece of wire material and comprises two spaced parallel portions disposed in diametrically oppositely arranged recesses with which said insulating body is provided, said sections being interconnected by an arcuate connecting section extending at right angles to said sections and adapted to receive a plug.

8. The coaxial plug connector of claim 7, characterized in that said sections of said inner contact are provided, approximately centrally between their ends, with angular portions extending towards one another and each forming an obtuse angle, the apices of said portions being adapted to cooperate as contact points with a plug.

9. The coaxial plug connector of claim 5, characterized in that, in a multiple arrangement, a plurality of contact sleeves are constructed as an integral component.

10. A coaxial plug connector as claimed in either of the preceding claims 1 or 9, characterized in that said supporting body is of L-shape, the lower limb of said supporting body constituting a base plate which is provided with a projecting positioning peg so as to be adapted to be mounted in a printed-circuit board.

11. The coaxial plug connector of claim 9, characterized in that a plurality of supporting bodies are weld integrated into a connector strip.

* * * * *